United States Patent [19]

Walk

[11] Patent Number: 4,827,572

[45] Date of Patent: May 9, 1989

[54] DEVICE FOR THE STRIPPING OF FIBER BALES

[75] Inventor: Johann Walk, Eichstaett, Fed. Rep. of Germany

[73] Assignee: Schubert & Salzer Maschinenfabrik Aktiengesellschaft, Ingolstadt, Fed. Rep. of Germany

[21] Appl. No.: 156,707

[22] Filed: Feb. 17, 1988

[30] Foreign Application Priority Data

Feb. 26, 1987 [DE] Fed. Rep. of Germany ..... 3706268

[51] Int. Cl.[4] ..... D01G 7/04

[52] U.S. Cl. ..... 19/89 R; 19/81

[58] Field of Search ..... 19/80 R, 81

[56] References Cited

U.S. PATENT DOCUMENTS

| | | | |
|---|---|---|---|
| 3,736,624 | 6/1973 | Ali et al. | 19/80 R |
| 4,240,182 | 12/1980 | Leifeld et al. | 19/81 |
| 4,297,767 | 11/1981 | Leifeld | 19/80 R |
| 4,477,944 | 10/1984 | Binder et al. | 19/80 R |
| 4,748,725 | 6/1988 | Temberg et al. | 19/81 X |
| 4,750,240 | 6/1988 | Temberg | 19/80 |

*Primary Examiner*—Louis K. Rimrodt

*Attorney, Agent, or Firm*—Dority & Manning

[57] ABSTRACT

In a plucking device, capable of travelling back and forth, for the plucking of fibers from bales of fiber two toothed rollers are provided. One is located before, and the other after, the toothed plucking roller, their axes being parallel to the axis of the latter. The arc of the base diameter at the bases of the teeth of these toothed rollers is tangent to a plane which lies within or below the plane tangent to the arc of the outside diameter of the plucking roller. The device makes it possible to limit the plucking action securely without using grates and to maintain it constant over the entire surface of the bale.

12 Claims, 2 Drawing Sheets

DEVICE FOR THE STRIPPING OF FIBER BALES

BACKGROUND OF THE INVENTION

The instant invention relates to a device for the plucking of fibers from fiber bales by means of a plucking roller with teeth and capable of being moved back and forth, and by means of two toothed rollers, one of which is located before and one after the stripping roller, their axes being parallel to that of said stripping roller and which press down on the bale surface.

In a known device for the plucking of fiber bales, the fiber material is plucked from the forward face of a layered stack in form of a parallelepipedon by means of a plucking roller with needles which is supported on a sled travelling back and forth horizontally (DE-PS No. 1,193,844). The tearing out of large pieces from the layered stack is prevented by means of retention elements in form of corrugated rollers installed before and after the plucking roller in the manner of drag rollers and which are pressed against the forward surface. The retention force of such corrugated rollers is unsatisfactory however, especially when the fiber material is plucked from the bale from above.

It has, therefore, been proposed that a retention device be provided in form of a pivotably supported grate which can be pressed down on the bale surface, through which the needles or teeth of the plucking roller extend (DE-OS No. 2,847,461). The disadvantage is that during the plucking operation grooves and ridges are formed on the surface of the bale, requiring costly measures to be taken for their elimination. In this device two driven pressure rollers equipped with toothed rings are also provided, one before and one after the plucking roller, the axes of the pressure rollers being parallel to the axis of said stripping roller. These rollers, which press down on the surface of the bales, are intended to prevent the bale from tipping over during plucking, as the grate alone, generally does not suffice to prevent this. No improvement in fiber retention is achieved by means of these pressure rollers.

SUMMARY OF THE INVENTION

The object of the instant invention is to create a device which makes it possible to safely limit the amount of plucked material without the utilization of grates, and to maintain it constant over the entire altitude of the bale.

This object is achieved in a device according to the instant invention in that the arc of the base diameter of the teeth of the toothed rollers is tangent to a plane which lies within or below a plane which is tangent to the arc of the outside diameter of the plucking roller.

In a further embodiment of the invention the plane tangent to the arc of the base diameter of the toothed rollers lies below the plane tangent to the arc of the outside diameter of the plucking roller by at least the height of a tooth of the toothed rollers.

In order to effect good retention in the output zone of the plucking roller even on lightly compressed fiber material, the plane tangent to the arc of the base diameter of the rear toothed roller (in the direction of plucking) lies lower than the plane tangent to the arc of the base diameter of the forward toothed roller. The retention force is adjusted for the amount of the material obtained, through the fact that the rear toothed roller is adjustably supported in relation to the bale surface. The fact that the rear toothed roller can be adjusted so as to shift around the center of the plucking roller ensures that the distance between this toothed roller and the plucking roller remains constant. The arc of the outside diameter of the rear toothed roller must be especially close to the arc of the outside diameter of the plucking roller. The maximum distance between the two arcs of outside diameters is 5 mm. The fact that the rear toothed roller is supported pivotably and is pressed on the bale by spring power makes it possible to pluck material remnants lying on the floor. The swivelling range of the toothed roller is, preferably, limited by a stop.

In a further embodiment of the invention the toothed rollers of the plucking device are driven at the travelling speed of the device. The fiber layers are thereby prevented from being shifted by the toothed rollers. In order to prevent a tearing away of fiber material by the toothed rollers, the teeth of the toothed roller are oriented in a direction opposite to the direction of rotation of the rollers. A constant hold-down or hold-back force is exerted upon the bale surface through the fact that the surfaces of the toothed rollers consist of toothed disks with the teeth offset in the longitudinal axial sense in relation to each other.

BRIEF DESCRIPTION OF THE DRAWINGS

An embodiment of the invention is described below in the drawings, where.

DETAILED DESCRIPTION OF THE DRAWINGS

Figure 1:
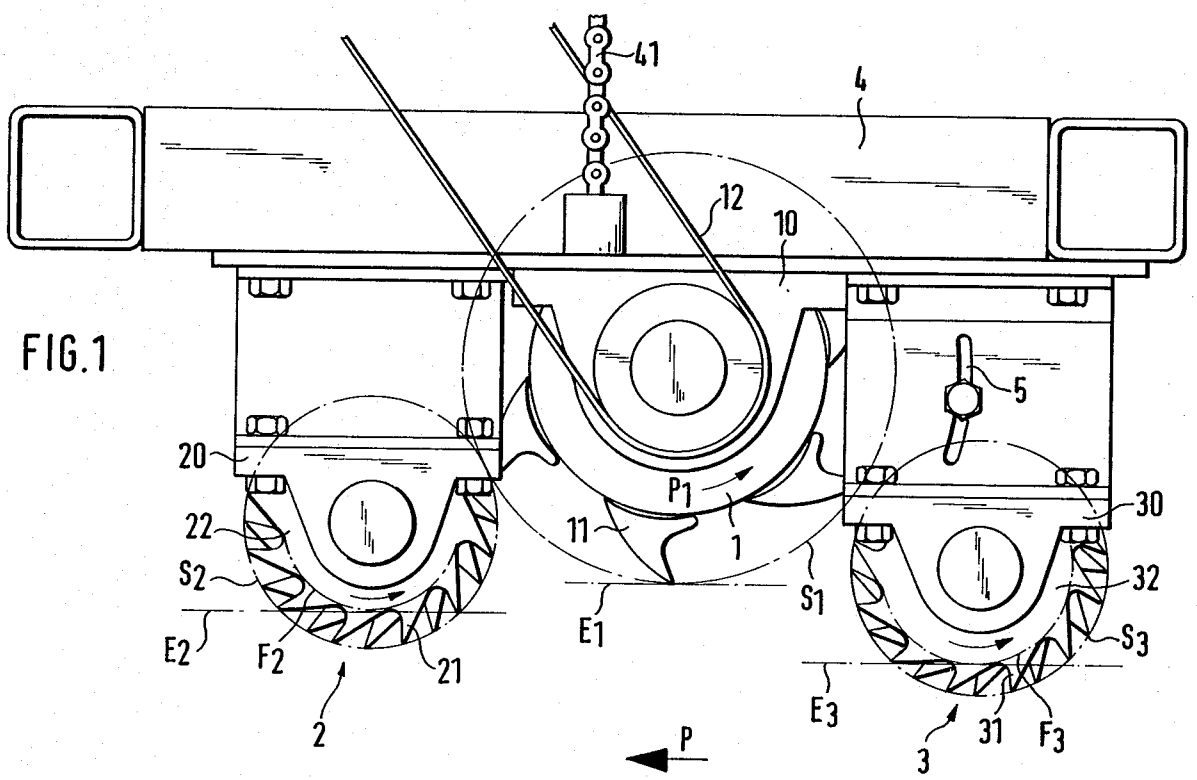
FIG. 1 is a side view of a plucking roller and two toothed rollers.

The plucking roller 1, and the toothed rollers 2 and 3 located before and behind it, in relation to the plucking direction as indicated by arrow P, are rotatably supported on bearings in holding members 10, 20, and 30, which are attached to a slide 4. Slide 4 is installed (in a manner not shown) in a travelling machine frame and can be moved up and down in vertical guides so as to bring the plucking roller 1 and the toothed rollers 2 and 3 into and out of engagement with the surface of the bales (not shown) to be plucked. The slide 4 is raised and lowered by chains 41. It is, however, also possible for the rollers to be supported on bearings in a boom of a known type which is installed on a travelling tower and can be moved up and down.

The plucking roller 1 is provided with teeth 11 on its surface which are inclined in the direction of rotation and roller 1 is driven in a counterclockwise direction (in the direction of arrow $P_1$). The driving force is transmitted by a belt 12. The toothed rollers 2 and 3 are driven in the same direction and are driven at the travelling speed of the device in plucking direction P. The clothings of the toothed rollers 2 and 3 consist of a plurality of toothed disks 22 and 32, the teeth 21 and 31 of which are offset with respect to each other in the longitudinal axial direction and are inclined in a direction opposite to the direction of rotation of the toothed rollers 2 and 3. In this arrangement the teeth 21 and 31 of the toothed rollers 2 and 3 are oriented in a plucking direction in relation to the teeth 11 of the plucking roller 1, which rotates substantially faster than the toothed rollers 2 and 3.

The toothed rollers 2 and 3 are located in immediate proximity of the plucking roller 1. The arc of the outside diameter $S_3$ of the rear toothed roller 3 must be located close to the arc of the outside diameter $S_1$ of the plucking roller 1. Provisions can be made for the arc of the outside diameter $S_3$ of the toothed roller 3 to overlap the arc of the outside diameter $S_1$ of the plucking roller or to be at a distance not to exceed 5 mm from the arc of the outside diameter $S_1$. The toothed rollers 2 and 3 are arranged vertically with respect to the plucking roller 1 so that the arc of the base diameter $F_2$, $F_3$ at the base of the teeth 21 and 31 of the toothed rollers 2 and 3 are tangent to a plane $E_2$ or $E_3$ situated within or below the plane $E_1$ tangent to the arc of the outside diameter $S_1$ at the tips of the teeth 11 of the plucking roller. In the preferred embodiment the planes $E_2$ and $E_3$ lie below the plane $E_1$ by at least the height of a tooth 21 or 31 of the toothed rollers. Since the toothed roller 3, which is located behind the plucking roller 1 (as seen in the direction of plucking) is especially important in determining how well the fiber material is held back and held down as it is plucked from the bale surface by the plucking roller 1, provisions are made for this roller to enter more deeply into the bale surface than the toothed roller 2. The plane $E_3$, which is tangent to the arc of the base diameter $F_3$ of the rear toothed roller 3, is therefore lower than the plane $E_2$ which is tangent to the arc of the base diameter $F_2$ of the forward toothed roller 2.

In order to be able to vary the depth to which the rear toothed roller 3 enters the bale surface, the toothed roller 3 is supported in an oblong arcuate slot 5 so as to be adjustable with respect to the bale surface. In this manner the toothed roller can be set lower for a less tightly compressed bale so as to exert a greater downward pressure upon the fiber material in order to prevent large fragments from being torn loose. The oblong slot 5 extends preferably along an arc of a circle drawn around the center of the plucking roller 1, so that its predetermined distance from the plucking roller 1 remains constant as the toothed roller 3 is adjusted.

Figure 2:
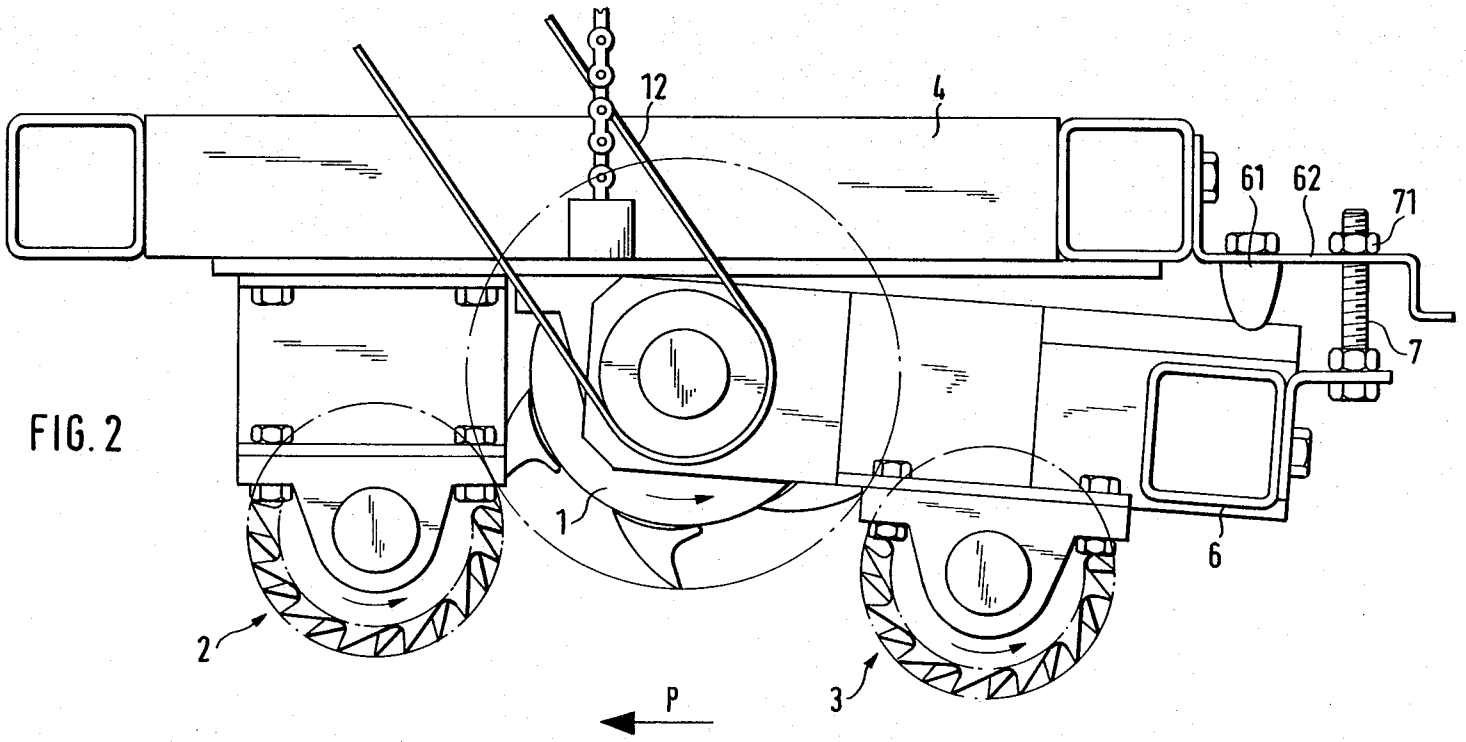
FIG. 2 shows a toothed roller supported pivotably and subjected to spring power.

In FIG. 2 the rear toothed roller 3 is attached at its two ends to arms 6, pivotably supported in the machine frame. The arms 6 are preferably supported on the axis of the plucking roller 1 and are capable of being swivelled around the latter, so that the toothed roller 3 maintains its predetermined distance from the arc of the outside diameter $s_1$ of the plucking roller 1 when it is swivelled.

The toothed roller 3 is pressed against the bale surface by the force, in this case the force of a rubber spring 61, applied at the free ends of the arms 6. The holder 62 of the rubber spring 61, which is attached to the slide 4, serves at the same time as a stop for an adjusting screw 7, attached to the arms 6. The downward swivelling range of the arms 6, in the direction of the bale surface, is limited by this stop. By turning the nut 71 on the adjusting screw 7, the swivelling range can be adjusted to the desired degree.

The arrangement of the toothed roller 3 (as shown in FIG. 2) has the advantage that the surface of engagement of the toothed roller into the bale is changed automatically as a function of the degree of bale compression. With lightly compressed bales or fiber layers a greater pressure is exerted than with tightly compressed material so that the material is held down securely in all cases and plucking of large pieces is prevented. The pivoting installation of the toothed roller 3 furthermore makes it possible to pluck without any difficulty even the last layer of material lying on the ground since that layer is also held down by the toothed roller 3 and cannot slide away.

I claim:

1. A plucking device for plucking fiber from the surface of a bale of fiber, comprising:

(a) a plucking roller, having a plurality of plucking teeth on its surface, supported for rotation about its longitudinal axis wherein the diameter of the teeth extends in an arc which is tangent to a plucking roller horizontal plane;

(b) a first toothed roller supported for rotation about its longitudinal axis which is parallel to, and spaced from, one side of the longitudinal axis of said plucking roller for pressing the surface of said bale, wherein the diameter of the base of the teeth on said first toothed roller extends in an arc which is tangent to a first toothed roller horizontal plane which has the maximum height of the horizontal plane of said plucking roller; and (c) a second toothed roller supported for rotation about its longitudinal axis which is parallel to, and spaced from, the other side of the longitudinal axis of said plucking roller for pressing the surface of said bale, wherein the diameter of the base of said second toothed roller is tangent to a second toothed roller horizontal plane which has the maximum height of the horizontal plane of said plucking roller.

2. A plucking device as set forth in claim 1, wherein the horizontal planes of said first and second toothed rollers lie below the horizontal plane of the plucking roller by at least the height of the teeth of said toothed rollers.

3. A plucking device as set forth in claim 1, wherein the horizontal plane of said second toothed roller is lower than the horizontal plane of said first toothed roller.

4. A plucking device as set forth in claim 1, wherein the support for the second toothed roller is adjustable to adjust the level of the horizontal plane for said second toothed roller with respect to the surface of the bale.

5. A plucking device as set forth in claim 4, wherein said second toothed roller is adjustable about the axis of said plucking roller.

6. A plucking device as set forth in claim 1, wherein the arc made by the tips of the teeth of said second toothed roller extends in close proximity to the arc of the tips of the teeth of the plucking roller.

7. A plucking device as set forth in claim 6, wherein the arc of the tooth tips of said second toothed roller is separated from the arc of the teeth of said plucking roller by a distance which does not exceed 5 mm.

8. A plucking device as set forth in claim 1, wherein said second toothed roller is supported for pivotal motion about the axis of said plucking roller and is resiliently pressed towards said fiber bale.

9. A plucking device as set forth in claim 8, wherein the pivoting range of said second toothed roller is limited.

10. A plucking device as set forth in claim 1, wherein said first and second toothed rollers are driven at the same travelling speed as the plucking device.

11. A plucking device as set forth in claim 1, wherein the teeth of said first and second toothed rollers are inclined in a direction opposite to the direction of their rotation

12. A plucking device as set forth in claim 1, wherein the teeth of each of said first and second toothed rollers comprise a plurality of toothed disks offset with respect to each other along the longitudinal axis of said toothed rollers.

* * * * *